US008740266B2

(12) United States Patent
Keller

(10) Patent No.: US 8,740,266 B2
(45) Date of Patent: Jun. 3, 2014

(54) SENTINEL EVENT REDUCING SAFETY KNOBS

(76) Inventor: Patrick E. Keller, Virginia Beach, CA (US)

( * ) Notice: Subject to any disclaimer, the term of this patent is extended or adjusted under 35 U.S.C. 154(b) by 563 days.

(21) Appl. No.: 12/505,352

(22) Filed: Jul. 17, 2009

(65) Prior Publication Data

US 2010/0013248 A1 Jan. 21, 2010

Related U.S. Application Data

(60) Provisional application No. 61/082,127, filed on Jul. 18, 2008.

(51) Int. Cl.
*E05B 1/00* (2006.01)

(52) U.S. Cl.
USPC ..... 292/347; 292/348; 292/351; 292/DIG. 21

(58) Field of Classification Search
USPC ..... 292/347, 348, 350, 355–357, DIG. 2 X, 292/351 X
See application file for complete search history.

(56) References Cited

U.S. PATENT DOCUMENTS

| | | | | |
|---|---|---|---|---|
| 606,724 | A | 7/1898 | Lucas | |
| 1,811,291 | A * | 6/1931 | Banker | 292/169.21 |
| D155,503 | S | 10/1949 | Gruen | |
| 2,606,782 | A * | 8/1952 | Harkleroad | 292/74 |
| D193,756 | S | 10/1962 | Parker | |
| 4,306,468 | A * | 12/1981 | Bolgert | 74/548 |
| D284,990 | S | 8/1986 | Ogilvie | |
| D285,107 | S | 8/1986 | Ogilvie | |
| D285,108 | S | 8/1986 | Ogilvie | |
| D285,245 | S | 8/1986 | Ogilvie | |
| D316,365 | S | 4/1991 | Hansen et al. | |
| D317,398 | S | 6/1991 | Hansen et al. | |
| D322,839 | S | 12/1991 | Kohler, Jr. | |
| 5,140,843 | A * | 8/1992 | Krueger | 70/429 |
| 5,190,327 | A * | 3/1993 | Lin | 292/348 |
| 5,722,273 | A * | 3/1998 | Lin et al. | 70/370 |
| 5,794,871 | A * | 8/1998 | Willetts | 292/288 |
| D421,293 | S | 2/2000 | Müllenmeister | |
| 6,840,070 | B1 * | 1/2005 | Huang et al. | 70/134 |
| D507,633 | S | 7/2005 | Spangler | |
| 7,024,823 | B2 | 4/2006 | Keller | |
| D532,673 | S | 11/2006 | Weinerman et al. | |
| D543,434 | S | 5/2007 | Weinerman et al. | |
| 7,273,242 | B2 * | 9/2007 | Godin Flott et al. | 292/347 |
| 7,373,694 | B1 | 5/2008 | Kopp | |
| D584,384 | S | 1/2009 | Schonherr et al. | |
| 7,631,655 | B1 | 12/2009 | Kopp | |
| 7,661,734 | B2 * | 2/2010 | Lignell | 292/348 |
| 8,430,436 | B2 * | 4/2013 | Shilts | 292/347 |
| 2010/0072762 | A1 * | 3/2010 | Marks | 292/336.3 |
| 2010/0126239 | A1 | 5/2010 | Berger | |
| 2011/0068927 | A1 * | 3/2011 | Berger | 340/573.1 |
| 2011/0120024 | A1 * | 5/2011 | Shilts | 49/506 |
| 2011/0174026 | A1 * | 7/2011 | Salvatore et al. | 70/91 |

* cited by examiner

*Primary Examiner* — Mark Williams
(74) *Attorney, Agent, or Firm* — Sheppard Mullin Richter & Hampton LLP

(57) ABSTRACT

There is disclosed herein a suicide prevention door handle and shower handle wherein each is designed to eliminate any area or structure that could be used to hold a belt, piece of clothing or the like as an aid in committing suicide by hanging. In each case, the safety knob comprises a tapered rose member or faceplate along with a cylinder wedge assembly or handle.

6 Claims, 4 Drawing Sheets

SENTINEL EVENT REDUCING SAFETY KNOBS

CROSS-REFERENCE TO RELATED APPLICATION

This application claims the benefit of provisional application Ser. No. 61/082,127, filed Jul. 18, 2008, which application is incorporated herein by reference.

FIELD

The disclosed embodiments relate generally to safety knobs adapted to significantly reduce or eliminate the occurrence of sentinel events and more particularly, but not exclusively, to safety knobs having particular constructions that prevents the physical means for an individual to hang him/herself.

BACKGROUND

Medical facilities are aware that some of their patient population is at risk of committing suicide, specifically hanging, while being treated in the medical facility. These suicides, referred to in the industry as sentinel events, typically occur either in the bathroom or in the shower stall of the medical facility.

Public use bathrooms typically have bathroom stalls, including a bathroom door and doorknob. The bathroom doors can be used as a platform or location for holding a belt or a piece of clothing to aid in committing suicide by hanging. Various systems for reducing sentinel events have been proposed, such as the sentinel event reduction system set forth in U.S. Pat. No. 7,024,823 entitled Sentinel Event Reduction System, the disclosure of which is incorporated herein by reference in its entirety The bathroom doorknob can also be used as a platform or location for holding a belt or a piece of clothing to aid in committing suicide by hanging.

Every bathroom or unit in a medical facility cannot be watched at the same time without enormous staff resources. Therefore, bathrooms, and specifically bathroom doorknobs, provide an area of opportunity for a sentinel event for patients at risk for suicide. Shower knobs also can be a problem.

To date, the problems of sentinel events in bathrooms are typically addressed by removing all bathroom stall hardware, including doors and doorknobs. While this reduces opportunities for sentinel events, it likewise eliminates all privacy that a patient may have.

Figure 1:
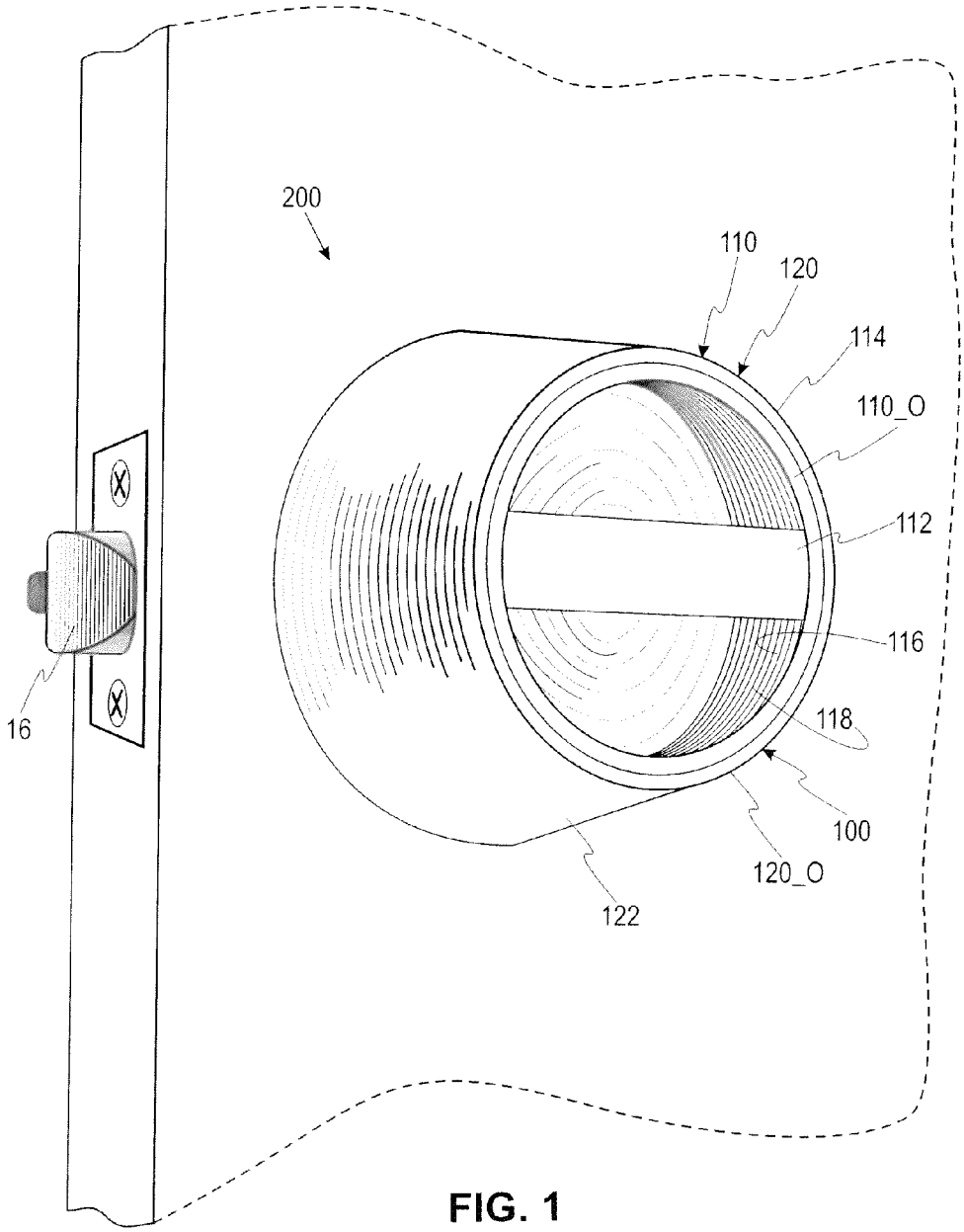
FIG. 1 illustrates an embodiment of a safety door knob, wherein the safety knob comprises a tapered rose member and a cylinder wedge assembly.

It should be noted that the Figures are not drawn to scale and that elements of similar structures or functions are generally represented by like reference numerals for illustrative purposes throughout the Figures. It also should be noted that the Figures are only intended to facilitate the description of the disclosed embodiments. The Figures do not illustrate every aspect of the disclosed embodiments and do not limit the scope of the disclosed embodiments.

DESCRIPTION OF THE PREFERRED EMBODIMENTS

A safety door knob 100 overcomes the foregoing drawbacks and addresses the problems described herein. The safety knob 100 described herein has been engineered so that any attempt to use it as a hanging platform will fail. Nothing can hang off the safety knob or be wedged within the safety knob without sliding or falling off because all foreseeable hanging points are removed. The sentinel event reducing safety knob includes a uniquely-engineered knob that prevents hanging of any material on the knob for use particularly in facilities where there are at risk patients who may attempt suicide, specifically by hanging.

The safety knob can be used in conjunction with any door that can be hung in any conventional door frame. It is encouraged that the safety knob be used in conjunction with the door described in the above-referenced U.S. Pat. No. 7,024,823.

Figure 2:
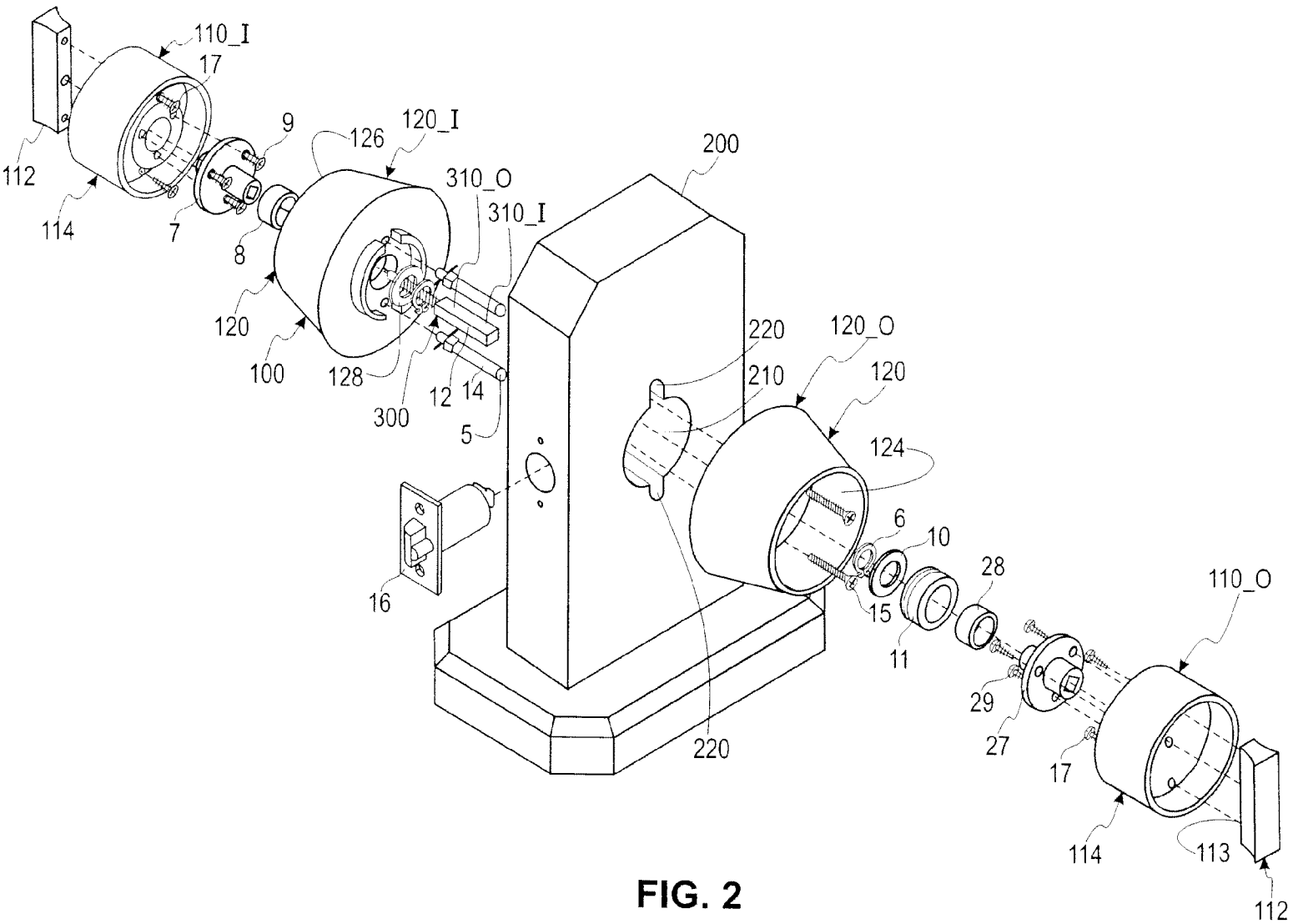
FIG. 2 is an exploded view of the safety knob of FIG. 1.

FIG. 1 illustrates a preferred embodiment of the sentinel event reducing safety knob 100. Turning to FIG. 1, the sentinel event reducing safety knob 100 is shown as including a cylinder wedge assembly 110, such as an outside cylinder wedge assembly 110_O, and a rose member 120, such as an outside rose 120_O, suitable for installation at a mounting structure 200, such as a door. The outside rose 120_O has a tapered outer surface 122. The outside rose 120_O also forms an internal chamber 124 (shown in FIG. 2) for receiving the outside cylinder wedge assembly 110_O. The outside cylinder wedge assembly 110_O preferably includes a safety pull wedge 112 and a cylinder member 114, which can comprise separate units as shown in FIG. 2 or can be integrated into a single unit. If provided as separate units, the safety pull wedge 112 and cylinder member 114 can be coupled via one or more fasteners, such as a screw 17 (shown in FIG. 2). The cylinder member 114 includes an inner surface 116 that defines an internal opening 118 within the cylinder member 114. When the safety pull wedge 112 is disposed within the internal opening 118, an outer surface 113 (shown in FIG. 2) of the safety pull wedge 112 is flush with the inner surface 116 of the cylinder member 114, and, hence, no space is present on the safety knob 100 to operate as a hanging point. The safety knob 100 can be activated, such as by rotating and/or translating, to extend and/or retract a locking mechanism 16. Thereby, when the outside cylinder wedge assembly 110_O is received within the outer rose 120_O, the safety knob 100 provides a knob surface that is not suitable for hanging.

FIG. 2 is an exploded view of the safety knob 100 of FIG. 1. As shown in FIG. 2, the safety knob 100 includes both the outer rose 120_O and the outer cylinder wedge assembly 110_O as well as an inner rose 120_I and an inner cylinder wedge assembly 110_I. The inner rose 120_I can be provided in the same manner as the outside rose 120_O described above with reference to FIG. 1. The inner rose 120_I includes an internal chamber 126 for receiving the inner cylinder wedge assembly 110_I. The inner cylinder wedge assembly 110_I preferably is provided in the manner set forth above with reference to the outer cylinder wedge assembly 110_O in FIG. 1.

Safety knob 100 can be used with any conventional latching mechanism 16. An illustrative latching mechanism is shown in FIG. 2. The latching mechanism 16 is disposed within the mounting structure 200 and can be activated by the safety knob 100 via conventional hardware 300. The conventional hardware 300 can be installed within an opening 210 formed by the mounting structure 200. The hardware 300 can be disposed within and extend through the opening 210 and includes an outside end region 310_O for coupling with the outside cylinder wedge assembly 110_O and an inside end region 310_I for coupling with the inside cylinder wedge assembly 110_I.

The outside end region 310_O of the hardware 300 can pass through an opening (not shown) formed within the outside rose 120_O and communicating with the internal chamber 124. Extending within the internal chamber 124, the outside end region 310_O can couple with the outside cylinder wedge assembly 110_O. Similarly, the inside end region 310_I of the hardware 300 can pass through an opening 128 formed within the inner rose 120_I and communicating with the internal chamber 126. Extending within the internal chamber 126, the inside end region 310_I can couple with the inside cylinder wedge assembly 110_I.

The inside cylinder wedge assembly 110_I and the outside cylinder wedge assembly 110_O each thereby communicate with the hardware 300 and can be activated, such as by rotating and/or translating, to extend and/or retract the locking mechanism 16.

The inside cylinder wedge assembly 110_I attaches to the inside end region 310_I. The inside end region 310_I can include an inside knob bushing 7 and an inside needle roller bearing 8, and can be coupled with the inside cylinder wedge assembly 110_I via one or more fasteners 9. Similarly, the outside cylinder wedge assembly 110_O attaches to the outside end region 310_O. The outside end region 310_O can include an outside knob bushing 27 and a outside needle roller bearing 28, and can be coupled with the outside cylinder wedge assembly 110_O via one or more fasteners 29.

A spindle 12 passes through the opening 210, interacting with the latching mechanism 16, extends into the internal chamber 124 of the outer rose 120_O, and mates with the outside knob bushing 27. Posts 14 include an internally threaded region 5 for receiving screws 15. The posts 14 are respectively received within channels 220 formed within the opening 210 and maintain the orientation of the safety knob 100.

Figure 3A:
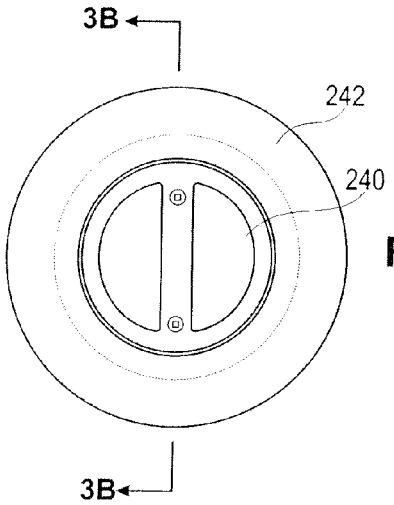
FIGS. 3*a* and 3*b* illustrate an embodiment of a safety shower valve knob.
Figure 3B:
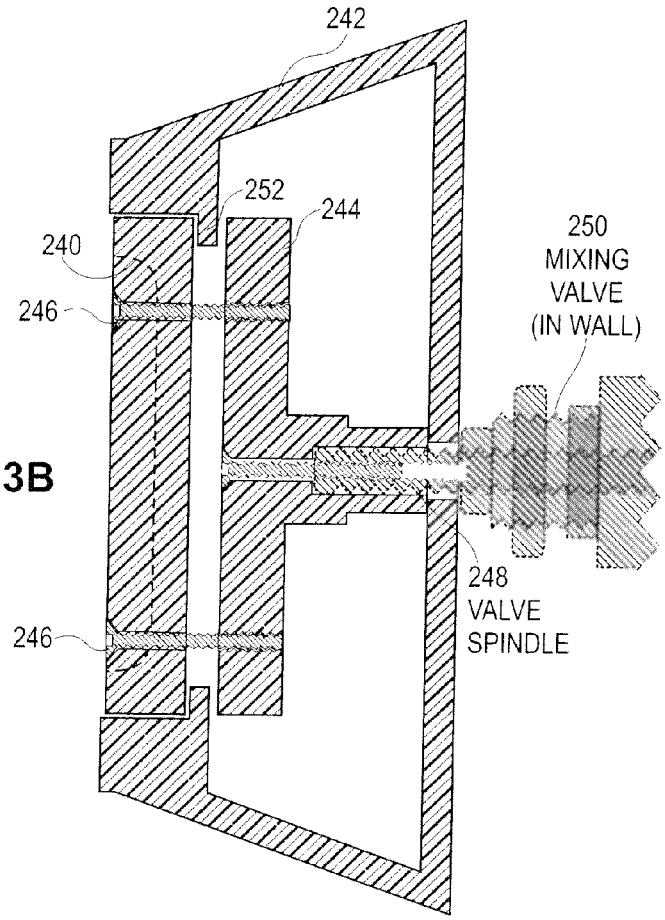
Figure 4A:
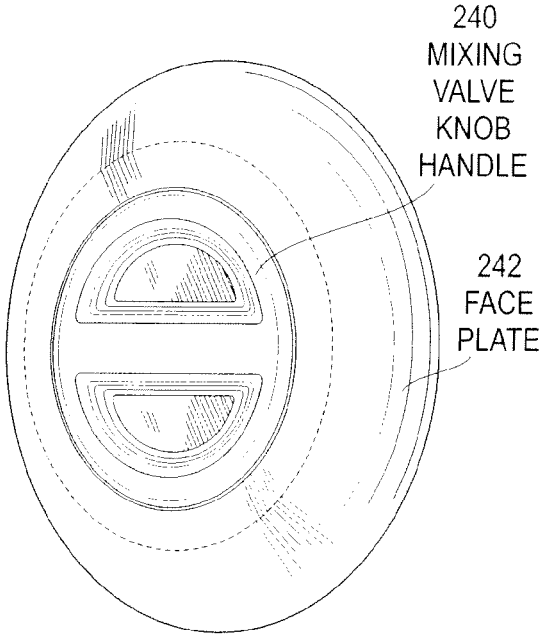
FIGS. 4*a*, 4B, and 4*c* illustrate the basic components of the shower valve knob.
Figure 4B:
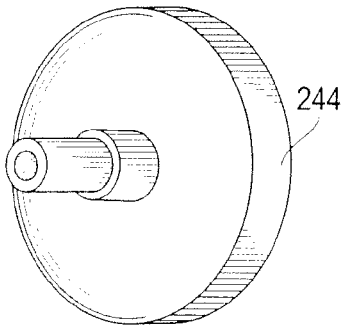
Figure 4C:
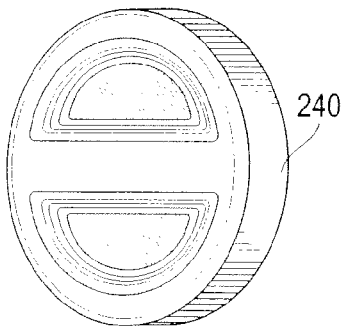

Turning now to FIGS. 3 and 4, a safety shower valve handle 240 is shown as a mixing valve handle recessed in a beveled faceplate 242. The mixing valve handle 240 is connected to a control knob 244 by suitable screws 246. The control knob is threaded onto the valve spindle 248 of the water mixing valve 250 which is within the shower wall.

Thus, this suicide prevention shower handle can replace any non-push type shower handle and faceplate. It preferably is made of high impact Corian material which will not rust nor corrode. The handle 240 and control knob 244 are securely bolted together with the lip 252 of the faceplate 242 between them as seen in FIG. 3*b*. This design prevents the handle from either being pulled apart or pushed in by a patient. It also prevents anything from being slipped behind the handle and used as a hanging point.

The disclosed embodiments are susceptible to various modifications and alternative forms, and specific examples thereof have been shown by way of example in the drawings and are herein described in detail. It should be understood, however, that the disclosed embodiments are not to be limited to the particular forms or methods disclosed, but to the contrary, the disclosed embodiments are to cover all modifications, equivalents, and alternatives.

What is claimed is:

1. A safety knob mechanism suitable for installation on a door, the safety knob mechanism comprising:

an inner safety knob that includes a first external rose member, said first rose member having a tapered external surface comprising a truncated cone, said rose member including a flat surface directly joined to said tapered external surface of said first rose member at an angle relative to said tapered surface, said flat surface adapted to be mounted flush with an external surface on a door;

an outer safety knob distal from said inner safety knob that includes a second external rose member, said second rose member having a tapered external surface, said rose member including a flat surface directly joined to said tapered external surface of said first rose member at an angle relative to said tapered surface, said flat surface adapted to be mounted flush with an external surface on a door;

each of said inner safety knob and said outer safety knob having an internal chamber which contains said latch activating mechanism, each safety knob providing a knob surface which is not suitable for use as a hanging platform; and a latching mechanism located between said inner and outer safety knobs, wherein said inner and outer safety knobs each has a latch activating member which does not require a key and which is coupled to said latching mechanism.

2. The safety knob mechanism of claim 1, wherein said latch activating mechanism comprises a tubular member having an inner surface and an external rim and a transverse member having a first end which extends to a first point proximal to the external rim of said tubular member and a second end which extends to a second point proximal to the external rim of said tubular member.

3. The safety knob mechanism of claim 2, wherein the ends of said transverse member are flush with the inner surface of said tubular member.

4. A suicide reduction safety knob mechanism suitable for installation on a door, comprising:

a first safety knob adapted to be placed on a first side of a door;

a second safety knob adapted to be placed on a second side of a door;

each of said first and said second safety knobs having a tapered external surface comprising a truncated cone which is directly joined to a flat surface at an angle relative to said tapered surface, said flat surface being adapted to be mounted flush with an external surface on a door;

a latching mechanism located between said safety knobs; and a latch activating member which does not require a key and which is coupled to said latching mechanism, said safety knobs being free of hanging points.

5. The safety knob mechanism of claim 4, wherein said latch activating mechanism comprises a tubular member having an inner surface and an external rim and a transverse member having a first end which extends to a first point proximal to the external rim of said tubular member and a second end which extends to a second point proximal to the external rim of said tubular member.

6. The safety knob mechanism of claim 5, wherein the ends of said transverse member are flush with the inner surface of said tubular member.

* * * * *